US006877720B1

(12) United States Patent
Dublin, Jr.

(10) Patent No.: US 6,877,720 B1
(45) Date of Patent: Apr. 12, 2005

(54) COMPACT GEOMETRY TENSIOMETER USING A SEGMENTED SHEAVE ASSEMBLY

(75) Inventor: Wilbur Leslie Dublin, Jr., Georgetown, TX (US)

(73) Assignee: Industrial Sensors and Instruments, Inc., Round Rock, TX (US)

( * ) Notice: Subject to any disclaimer, the term of this patent is extended or adjusted under 35 U.S.C. 154(b) by 97 days.

(21) Appl. No.: 10/368,537

(22) Filed: Feb. 18, 2003

(51) Int. Cl.[7] ..... B66D 3/04
(52) U.S. Cl. ..... 254/390
(58) Field of Search ..... 254/390, 393, 254/394, 396, 383

(56) References Cited

U.S. PATENT DOCUMENTS 3,944,185 A * 3/1976 Evans ..... 254/378
4,030,569 A * 6/1977 Berkovitz ..... 187/254
4,555,091 A * 11/1985 May et al. ..... 254/267
4,570,245 A 2/1986 Thigpen
4,989,450 A 2/1991 Shoberg et al.
5,149,059 A * 9/1992 Monahan ..... 254/394
5,461,929 A 10/1995 Jordan

* cited by examiner

*Primary Examiner*—Emmanuel Marcelo
(74) *Attorney, Agent, or Firm*—Law Office of Tim Cook P.C.

(57) ABSTRACT

A tensiometer for measuring tension in a tubular, such as a cable, using segmented sheave assemblies is provided. The precision of a tension measurement, and the bending stress to which the tubular is exposed during the tension measurement, are functions of the effective radii of sheaves comprising the tensiometer. A segmented sheave assembly is much smaller dimensionally than a sheave wheel with the same effective radius. For given operating specifications, the tensiometer comprising segmented sheave assemblies is, therefore, much more compact than a tensiometer comprising conventional sheave wheels.

9 Claims, 6 Drawing Sheets

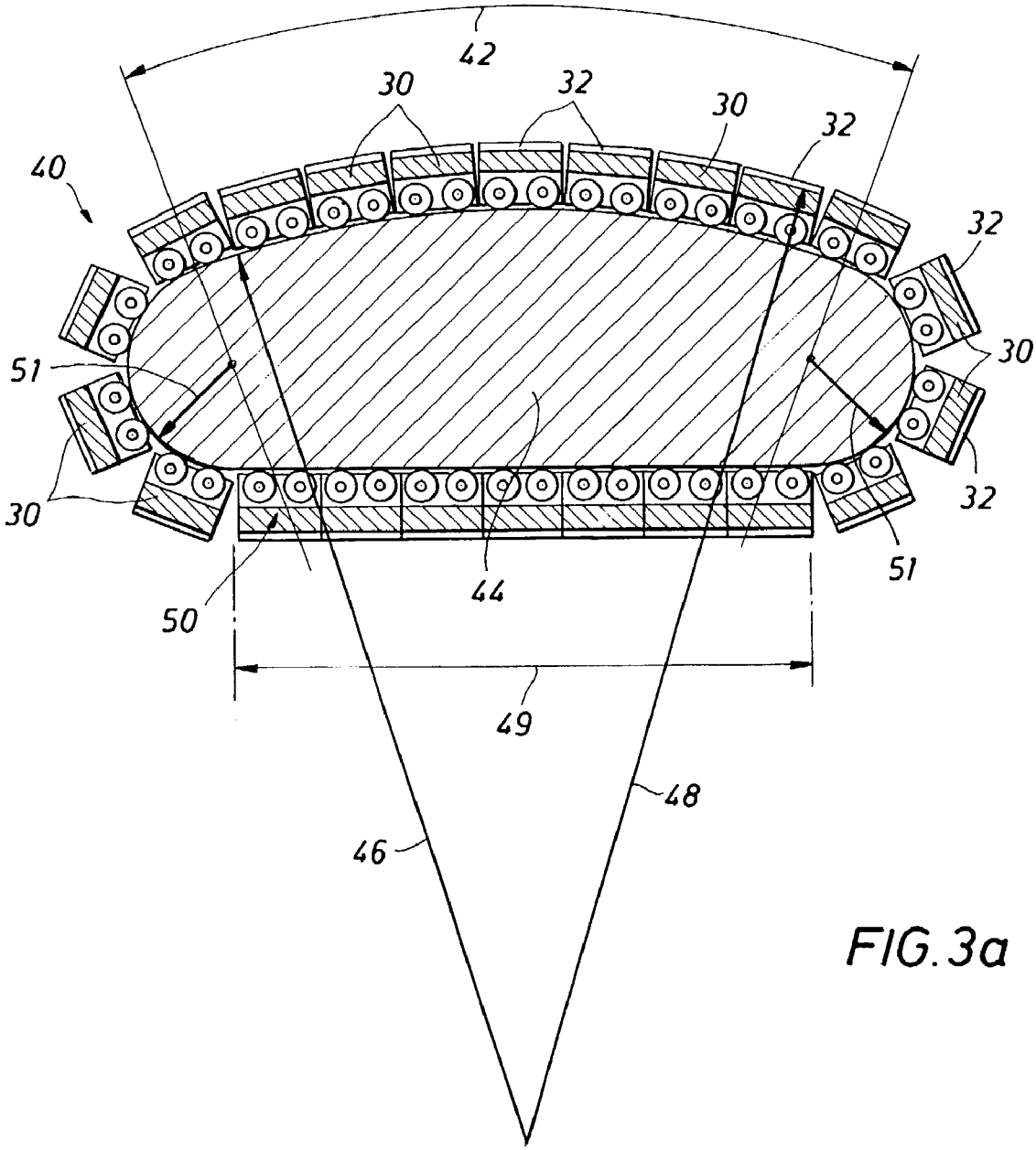
FIG. 3a
FIG. 3b
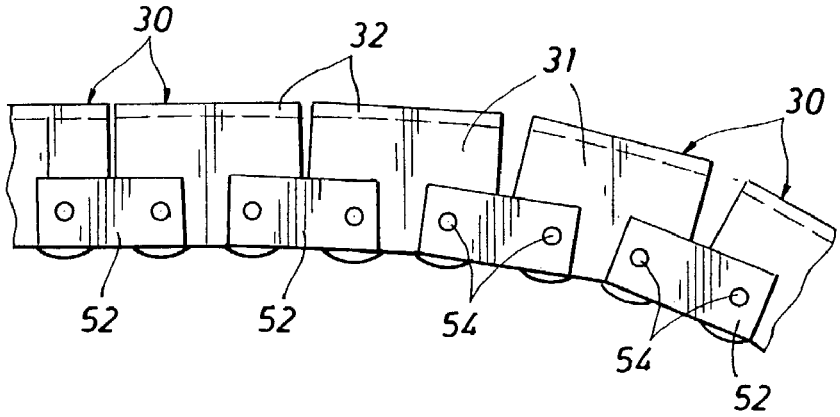

FIG. 3c
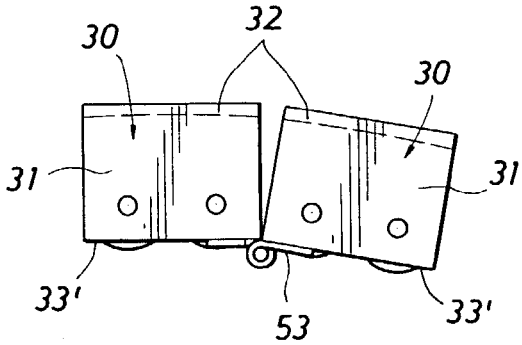
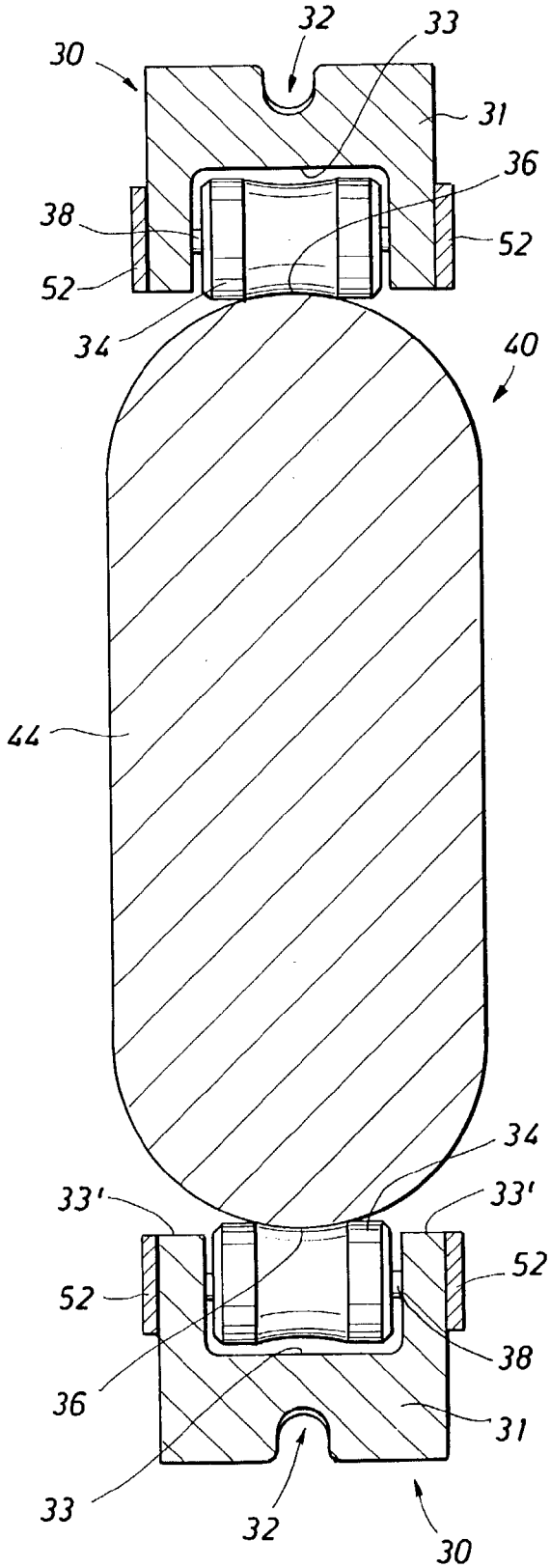
FIG. 4a
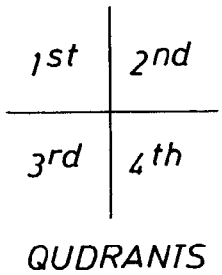
FIG. 3d 250
18
254
255
257
256
F
F
18
F
259
258
F
18
252
253

260
18
271
269
268
F1"
18
F1
266
267
18
F1"
265
264
18
262
263
18

COMPACT GEOMETRY TENSIOMETER USING A SEGMENTED SHEAVE ASSEMBLY

FIELD OF THE INVENTION

This invention is directed toward measuring tension in a tubular such as a cable, and more particularly directed toward a tensiometer comprising a measurement sheave and alternately one or more guide sheaves, wherein preferably all sheaves are compacted in physical dimensions using a chain of segmented sheave elements rotatable along a rollway.

BACKGROUND OF THE INVENTION

It is common in many fields to use lifting equipment consisting of a tubular with one end attached to a winch mechanism to disperse and to retrieve the tubular. The opposing end of the tubular is attached to an object to be lifted. In the context of this disclosure, "tubular" refers to any axial structure which can be coiled around a winch, including cables, wires, belts, hollow tubes of cylindrical or other shapes, ropes and other cordage, and the like. As an example, cranes utilizing a winch and a metal cable are used in construction to hoist beams, concrete, roofing material and other construction material as a structure is being built. As another example, many types of winch-cable lifting devices employ metal cable, rope or other cordage to load and unload cargo. As yet another example, "draw works" consisting of a lifting mechanism and various tubulars attached thereto are used in hydrocarbon production to drill well boreholes, to dispose equipment within the boreholes, and to convey equipment within the borehole to measure properties of material penetrated by the borehole.

From operational, maintenance and safety aspects, it is usually desirable to measure tension in the tubular attached to the winch. Operationally, these devices have a lifting limit therefore a measure of tubular tension is useful in remaining within limits of the device. From a maintenance aspect, abnormal tubular tension often is an indication of an equipment maintenance problem. From a safety aspect, excess tubular tension can result in cable breakage with risk to human life and physical surroundings.

It is usually desirable to measure tension both when the tubular is stationary and when the cable is axially moving due to the action of the winch. Apparatus to measure axial tension is referred to as a tensiometer. One type of tensiometer employs at least one sheave. Stated simply, a sheave is a device that changes axial direction of a cable, wire or any other type of tubular that passes over the sheave. The most common form of sheave is a circular "wheel" with a groove in the outer perimeter of the wheel to receive the tubular. Tensiometers can employ sheaves in a variety of embodiments. Tensiometers can comprise a single sheave, or one or more measurement sheaves cooperating with one or more guide sheaves. As an example, a tensiometer can comprise a measurement sheave wheel and first and second guide sheave wheels disposed on opposing sides of the measurement sheave. This type of tensiometer will be illustrated and discussed in more detail in a subsequent section of this disclosure, and will be used as an example to illustrate basic principles applicable to other embodiments of sheave type tensiometers. Briefly, the tubular enters the tensiometer, passes over a first guide sheave wheel, is deflected from its original path when passing over the measurement sheave wheel, and is returned to its original path when passing over a second guide sheave. The deflected tubular exerts a force on the measurement sheave wheel which is typically perpendicular to the original path of the tubular. A measure of this force can be related to axial tension in the tubular.

Effective diameters and relative positioning of measurement and guide sheave wheels in all embodiments of sheave tensiometers affect the precision of the tension measurement. The term "wrap" is defined as an arc in which the tubular contacts a sheave wheel. In general, a greater deflection of the tubular results in a more precise measurement of tension. Stated another way, resolution and stress on retaining hardware of the tensiometer increase as the angle of wrap increases. Tubular bending stress is inversely proportional to the radius of bend when the tubular is deflected. Bending stress does not, however, increase with the angle of wrap. For a given angle of deflection (therefore a given measurement precision), bending can be lessened by increasing the diameters of the sheave wheels. It is, therefore, desirable for the measurement and guide sheaves to be as large in diameter as possible while still meeting other dimensional restrictions of the tensiometer. Unfortunately, space on most lifting devices is usually limited therefore forcing a compromise in selecting a tensiometer between measurement precision and size.

SUMMARY OF THE INVENTION

The present invention addresses this need in the art by providing a segmented sheave assembly which rides over a stationary rollway, defining the desired arc of curvature for the desired deflection of the tubular. In a first aspect of the invention, the segmented sheave assembly comprised a plurality of sheave segments each comprising a segment body. Each of the segmented bodies includes at least one roller disposed on a side of said segment body to ride against the rollway. An axial groove is formed in each segment body on a side opposing the roller(s) to receive the tubular. The rollway defines a major axis and a minor axis, with a perimeter which contacts said at least one roller disposed in each of the plurality of sheave segments. The segment bodies are joined to one another with linking means to form a continuous sheave chain encircling and rotatable about the rollway.

In another aspect, the present invention provides a method for forming a tensiometer. The method so defined comprises providing one or more sheave segments, each of the one or more sheave segments comprising a segment body, at least one roller disposed on one side of said segment body, and an axial groove in said segment body on a side opposing said at least one roller. The method further includes linking the plurality of sheave segments to form a continuous chain encircling a rollway with a major and a minor axis and with a perimeter which contacts said at least one roller disposed in each of the plurality of sheave elements. The plurality of sheave elements are linked with linking means pivotally attached to adjacent segment bodies. Finally, the chain is rotatable about said rollway.

It is well known that the precision of a tension measurement, and the bending stress to which the tubular is exposed during the tension measurement, are functions of the effective radii of the one or more sheaves comprising the tensiometer. The segmented sheave assembly of this invention is much smaller in overall dimensions than a sheave wheel with the same effective radius. Thus, for given operating specifications, the tensiometer comprising one or more segmented sheave assemblies is much more compact than a tensiometer comprising one or more conventional sheave wheels. These and other aspects and advantages of the invention will be apparent to those skilled in the art from a review of the following detailed description along with the accompanying drawing figures.

BRIEF DESCRIPTION OF THE DRAWINGS

So that the manner in which the above recited features, advantages, and objects the present invention are obtained and can be understood in detail, more particular description of the invention, briefly summarized above, may be had by reference to the embodiments thereof which are illustrated in the appended drawings.

FIG. 3*a* is a side view of a segmented sheave assembly.

FIG. 3*b* illustrates sheave elements connected using pivotal connection means comprising side plates.

FIG. 3*c* illustrates sheave elements connected using pivotal connection means comprising hinges.

FIG. 3*d* is a graph illustrating certain defined quadrants for explanatory purposes.

FIG. 4*a* is a cross sectional view of a segmented sheave assembly.

DETAILED DESCRIPTION OF THE PREFERRED EMBODIMENTS

This invention sets forth a segmented sheave assembly, and a tensiometer for measuring tension in a tubular using segmented sheave assemblies. The precision of a tension measurement, and the bending stress to which the tubular is exposed during the tension measurement, are functions of the effective radii of sheaves comprising the tensiometer. A segmented sheave assembly is much smaller dimensionally than a sheave wheel with the same effective radius. For given operating specifications, a tensiometer comprising segmented sheave assemblies is, therefore, much more compact than a tensiometer comprising conventional sheave wheels.

For purposes of this disclosure, a cable will be used as an example of a tubular. It should be understood, however, that disclosed apparatus and methods are equally applicable to a wide range of tubulars including, but not limited to, wires, hollow tubes of cylindrical or other shapes, belts, ropes and other cordage, and the like.

Basic Principles

Figure 1:
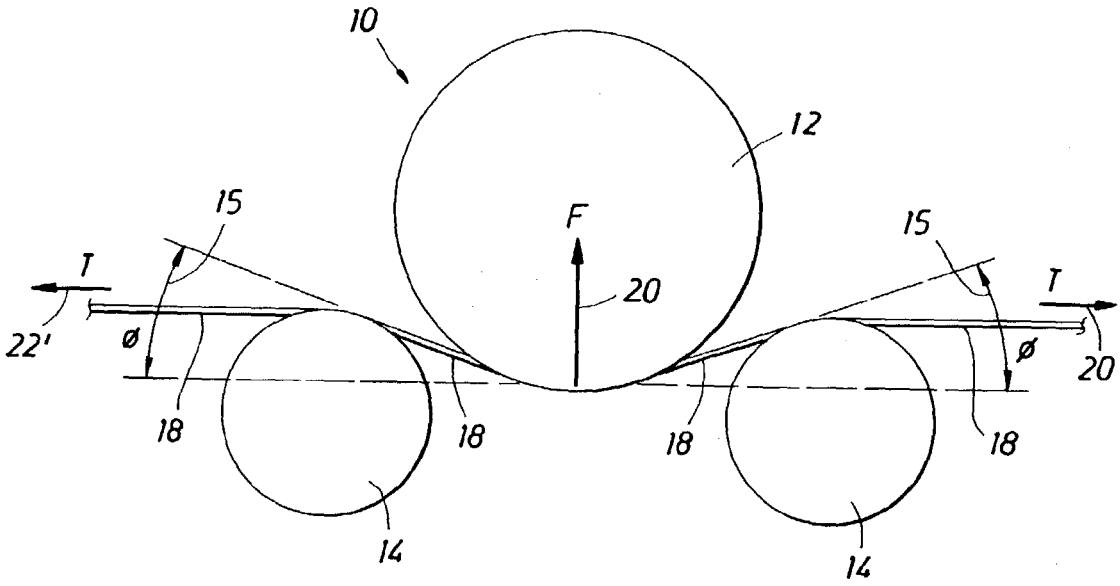
FIG. 1 (PRIOR ART)
FIG. 1 illustrates the basic principles of sheave type tensiometers using a three sheave tensiometer as an example.

The basic principles of measuring tension in a cable are illustrated using a three sheave wheel tensiometer. These basic principles are applicable to other embodiments, as will be apparent to those skilled in the art. Sheave wheels of this moving cable tensiometer are fixed relative to each other. Each sheave wheel rotates due to friction between the cable and the rim of the sheave which the moving cable contacts. FIG. 1 illustrates conceptually a three wheel tensiometer 10 consisting of a measurement sheave wheel 12 flanked on either side by a first guide sheave wheel 14 and a second guide sheave wheel 16. A cable passes over the first guide wheel 14, then under the measurement sheave wheel 12, and finally over the second guide wheel 14. Tension in the cable is indicated with the vectors 22 and 22'. FIG. 1 illustrates an example in which a cable 18 enters and exits the tensiometer 10 in the same axial direction. This is further indicated by the opposing but parallel vectors 22 and 22'. The axes of guide wheels 14 and 16 are displaced from the axis of the measurement wheel 12 so that the cable 18 is deflected downward an angle (numbered in FIG. 1 with element 15) as the cable passes from the guide sheave wheel 14 to the measurement sheave wheel 12. The cable is deflected upward by same angle Φ as the cable passes from the measurement sheave wheel to the guide sheave wheel 16 thereby returning the cable exiting from the tensiometer 10 to its original axial direction. The tension force in the deflected cable 18 exerts a perpendicular reaction force F on the measurement sheave wheel 12, as indicated by the vector 20. The tension force T is expressed mathematically by the relationship $$T=F/(2\sin\Phi)$$

where Φ is a known design parameter of the tensiometer 10, and F is measured with a suitable means such as a strain gauge affixed to the measurement sheave wheel 12. The relationship can be expressed as general functional relationship $$T=f(K,F)$$

where K is a design constant of the tensiometer including effective radii and positions of sheave elements. Tension can be measured either with the cable 18 moving or with the cable stationary.

The bending stress in the cable 18 is inversely proportional to the radii of the sheave wheels 12, 14, and 16 over which it passes. It is advantageous, therefore, for the sheave wheels 12, 14, and 16 to be as large as possible to minimize damage to the cable 18. Critical cable bending fatigue loading or permanent deformation would result from the cable's conformance to the smaller diameter guide sheave wheels 14 and 16.

There are many variations in the three sheave wheel tensiometer arrangement that can be used to implement a particular need. As an example, the relative positions of the measurement and guide sheave wheels can be increased or decreased thereby varying Φ and the ultimate sensitivity of the measurement. The relative and absolute diameters of the wheels 12, 14, and 16 can be varied with, as an example, the radii of all wheels being the same. As yet another example, relative and absolute diameters can all be different. It will be understood by those skilled in the art that other changes in the configuration of the tensiometer 10 can be implemented, but with the basic principles of operation remaining the same. It will also be illustrated in subsequent sections of this disclosure that these basic principles are applicable to tensiometer embodiments comprising more or fewer sheaves. In all cases, however, the sheaves 12, 14, and 16 are conceptually circular in configuration.

The Segmented Sheave Assembly

Figure 2A:
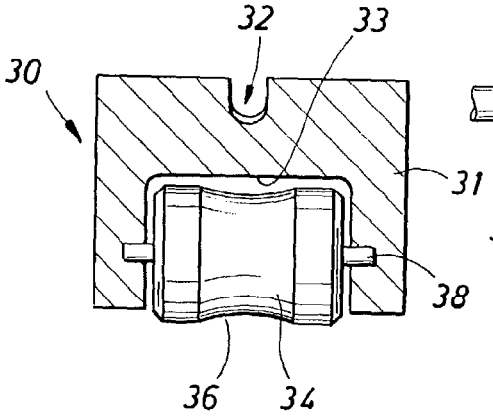
FIG. 2*a* is an axial sectional view of a sheave element.

FIG. 2*a* shows a cross sectional view of a sheave element 30 comprising a segment body 31. A roller 34 is shown disposed in a cavity, defined by the walls 33, in the segment body 31, and preferably has a concave contoured surface 36 to receive and match a convex rollway perimeter as will be discussed in a subsequent section. The roller 34 is rotatable on an axle pin 38 affixed to the segment body 31. An axial groove 32 is formed on the opposing side of the segment body 31, and receives a cable (see FIG. 2*b*) as will be discussed in a subsequent section. The axial groove is preferably not flat, but is formed with a radius of curvature 48 as described below in respect of FIG. 3*a*.

Figure 2B:
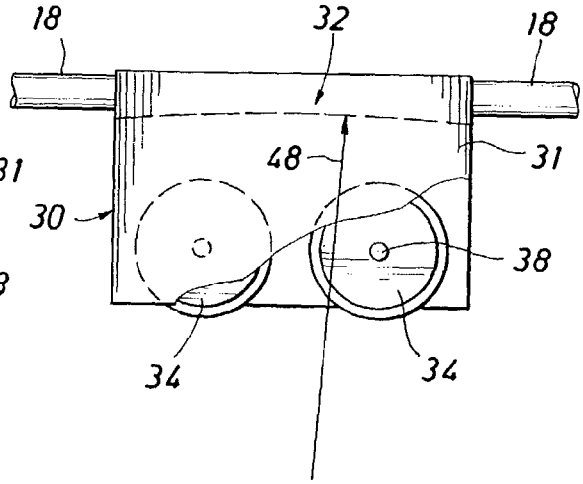
FIG. 2*b* is a side cutaway view of a sheave element.

FIG. 2*b* shows a side, cutaway view of the sheave element 30. Two rollers 34 are preferred, but a single roller can be used in each sheave element while preserving the overall concept of the invention. A cable 18 is shown in the groove 32.

Referring to both FIGS. 2*a* and 2*b*, the segment body 31 is preferably formed of hardened stainless steel investment castings, forgings, composite, or ceramic elements drilled for axle pins 38, but may also be formed in other manners and of other materials known in the art. The axial groove 32 is preferably machined by grinding to a uniform effective sheave radius 48 or "load arc" as will be illustrated more clearly in FIGS. 3*a*, 3*b*, and 3*c*.

FIG. 3*a* is a side view of a segmented sheave assembly 40. Sheave elements 30 are linked together with pivoting linking means (see FIGS. 3*b*, 3*c*, 4*a*, and 4*b*) to form a continuous chain 50 encircling the perimeter of a rollway 44. The sheave segments 30 are loaded by cable tension only on that portion of the chain 50 and rollway 44 where the cable 18 (not shown in FIGS. 3*a*, 3*b*, and 3*c* for purposes of clarity) contacts axial grooves 32. This effect is nearly that of a continuous sheave wheel as will be detailed in the following sections. Friction between the moving cable 18 and the axial grooves 32 (see FIG. 2*b*) causes the chain 50 to rotate around the perimeter of the rollway 44.

Still referring to FIG. 3*a*, the rollway 44 is fabricated with a curvature to change the direction of the contacting cable 18. Examples of this curvature can be, but are not limited to, the form of at least a portion of an "approximate ellipse", or a "four center" ellipse. An "approximate ellipse", or a "four center" ellipse, is a geometric construction for approximating an ellipse of given major and minor axis lengths (see "Technical Drawing", Giesecke, Mitchell, Spencer and Hill; Macmillan, New York, N.Y., Sixth Edition, 1974, page 112). The line 46 illustrates the major radius for the rollway 44, and the line 48 illustrates the major radius for the axial grooves 32, which receive the cable. The rollway 44 preferably contains only true arcs to yield nearly full support to the cable 18 at points of contact with sheave segments 30, except for gaps between segments, so that the bending moment is virtually as constant as a full sheave wheel. A load arc over which the cable 18 contacts the sheave elements is shown at 42. Grooves 32 of the sheave elements 30 are preferably machined axially to match the load arc 42, as discussed previously and illustrated in FIGS. 2*b* and 4*a*. The tension induced load reacts only on the load arc portion 42 of the segmented sheave assembly 40 that deflects or redirects the cable. Friction between the cable 18 and the sheave elements 30 within the load arc 42 rotate the chain 50 about the rollway 44 as the cable is moved axially.

Again referring to FIG. 3*a*, the minor radii 51 have been reduced and extended to 90 degrees in the 3rd and 4th quadrants (FIG. 3*d*) to provide a preferably linear return path 49 for the segmented sheave assembly 40, thereby reducing the size of the segmented sheave assembly 40.

Optionally, the rollway 44 can be formed in a full approximate ellipse contour (not shown) if absolute minimum size of the segmented sheave assembly 40 is not required. In this embodiment, the return path 49 shown in FIG. 3*a* will not be linear. Since only the sheave elements 30 passing along one major radius load arc 42 are loaded, the assembly can be rotated or "flipped" about the major axis of the rollway thereby providing a "fresh" arc for loading. This essentially doubles the operational life of the rollway 44.

FIG. 3*b* is a side view illustrating the sheave elements 30 linked together with linking means comprising side plates 52 pivotally mounted to adjacent segment bodies 31. Side plates are mounted on opposing sides of the segment bodies as better shown in FIG. 4*a*.

FIG. 3*c* illustrates an alternate linking means comprising hinges 53 affixed to surfaces 33' of adjacent segment bodies 31. A hinge 53 is preferably affixed to the surface 33' on each side of the roller 34 (see FIG. 4*a*) for lateral stability of the chain 50.

FIG. 4*a* is a cross sectional view of the segmented sheave assembly 40. The rollers 34 are preferably contoured to a concave surface 36 to match the cross sectional perimeter convex contour of the rollway 44. Grooves 32 in the sheave segments 30 are preferably fabricated to match the curvature of the load arc 42 illustrated in FIG. 3*a*. Linking means for adjacent sheave segments 30 are shown as side plates 52 pivotally mounted to adjacent segment bodies 31.

Again referring to FIG. 4*a*, the loaded portion of the chain 50 maybe exposed to side loads in some applications. These side loads would tend to rotate loaded sheave segments 30 about the long axis of the rollway 44, since the contours 36 of the rollway perimeter and the rollers 34 offer little resistance to side loading.

Figure 4B:
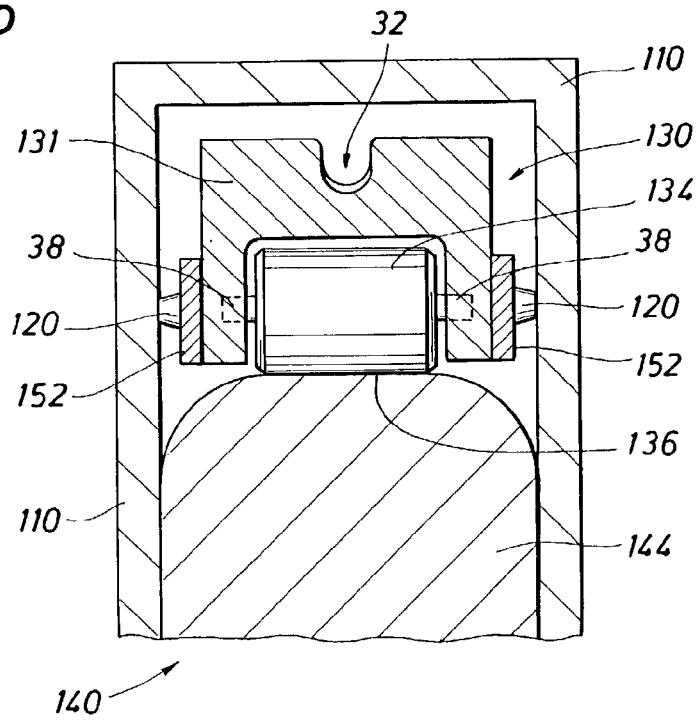
FIG. 4*b* is a partial cross sectional view of an alternate segmented sheave assembly.

FIG. 4*b* is a partial cross sectional view of an alternate segmented sheave assembly 140. In this embodiment, rollers 134 are fabricated flat at a surface 136 to match a flat cross sectional perimeter of a rollway 144. Grooves 32 in sheave segments 130 are again preferably fabricated to match the curvature of the load arc 42 illustrated in FIG. 3*a*. Linking means for adjacent sheave segments 130 are shown as side plates 152 pivotally mounted to adjacent segment bodies 131. The segmented sheave assembly is enclosed in a housing 110 with lateral internal dimensions flush with flat sides of the rollway 144, and further with penetrations (not shown) of adequate clearance for cable entry and exit. Needle bearings or bearing inserts 120 between the side plates 152 and the housing 110 are used as lower friction alternatives. Bearings 120 can be inserts of Vespel, Teflon, or other suitable bearing material. Sidewall restraint is effected by the bearing inserts 120 acting between the side plates 152 and the segment body 131.

Tensiometer Comprising Three Segmented Sheave Assemblies

Figure 5:
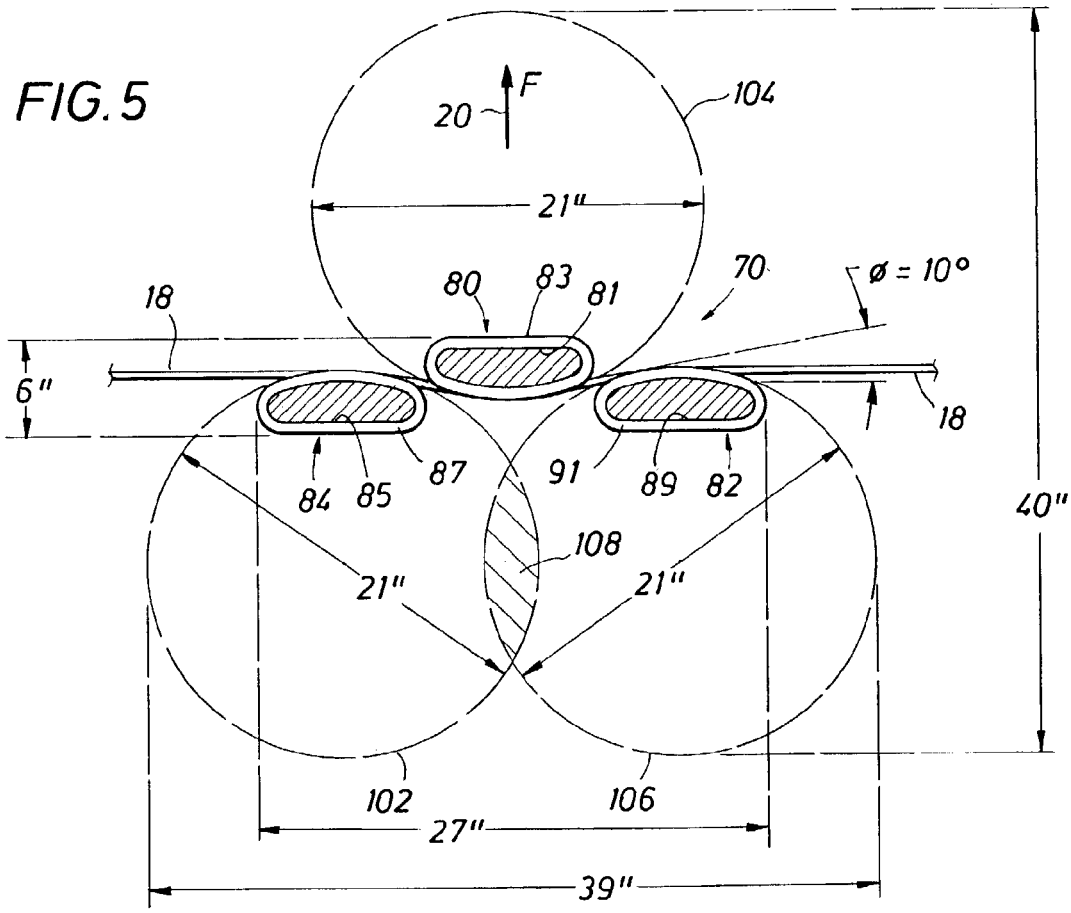
FIG. 5 is a tensiometer comprising three segmented sheave assemblies.

FIG. 5 illustrates three segmented sheave assemblies configured as a tensiometer 70. The three sheave embodiment is discussed in detail, with other embodiments comprising one to five sheaves being disclosed in subsequent sections of this disclosure. First and second guide segmented sheave assemblies 82 and 84 are disposed on opposite sides of a measurement segmented sheave assembly 80. Load arcs (see FIG. 3*a*) of the first and second guide segmented sheave assemblies are oriented in the same direction. The load arc of the measurement segmented sheave assembly is oriented in a direction opposite to those of the guide segmented sheave assembly load arcs. The perimeters of the first guide, second guide and measurement segmented sheave assemblies are indicated at 85, 89, and 81, respectively. The external envelopes of the first guide, second guide and measurement segmented sheave assemblies are indicated at 87, 91 and 83, respectively. The relative positions of the segmented sheave assemblies are positioned so that a cable passing through the tensiometer 70 is deflected within the tensiometer. More specifically, the cable 18 passes over the load arc of the first guide segmented sheave assembly 84, is deflected and passes over the load arc of the measurement segmented sheave assembly 80, is again deflected and passes over the load arc of the second segmented sheave assembly 82, where it is once again deflected and returned to its original axial path. As discussed previously, tension in the cable 18 exerts a reaction force F illustrated conceptually by the vector 20. A measure of force F, along with a knowledge of cable deflection angles Φ, is used to determine tension T in the cable 18.

Means for measuring the force F include, but are not limited to:

(a) centralized and stabilized shear web or webs measuring strain from the reaction stress or stresses in the rollway's mounting structure (not shown);

(b) a non-rotating (relative to the rollway) strain axle to react the force F on the measurement segmented sheave assembly; and (c) a separate load cell, with a single degree of freedom, reacting the force F to maintain a register of the measuring segment to those of the guides.

Again referring to FIG. 5, specific dimensions of elements are used as examples to illustrate how the overall dimensions of the segmented sheave assembly tensiometer 70 are reduced from a tensiometer producing the same measurement properties, but using full sheave wheels. A first guide sheave wheel, a measurement sheave wheel and a second guide sheave wheel are indicated as broken circles at 102, 104 and 106, respectively. For purposes of illustration, the diameter of each sheave wheel is 21 inches (in.). These sheave wheels produce the same load arc as the guide (84, 82) and measurement (80) segmented sheave assemblies that are shown overlaying the corresponding sheave wheels. Furthermore, the hypothetical positioning of the sheave wheels 102, 104 and 106 produce the same cable deflection angles, which is 10 degrees for this example. Stated another way, the segmented sheave assembly tensiometer 70 and the corresponding sheave wheel tensiometer will exhibit the same precision and exert the same bending stress on the cable 18 passing through. The vertical dimension of the sheave wheel tensiometer is 40", and the horizontal dimension is 39". The vertical dimension of the corresponding segmented sheave assembly tensiometer is 6" and the horizontal dimension is 27". FIG. 5 graphically illustrates the significant reduction in tensiometer size using segmented sheave assemblies. It should be noted that the guide sheave wheels 102 and 106 overlap at 108, which, in practice, would necessitate the use of smaller diameter guide sheave wheels with corresponding increase in bending stress exerted on the cable.

Still referring to FIG. 5, it is again noted that load is reacted only with the load arc portion of each segmented sheave assembly which, in turn, deflects the cable 18 within the tensiometer 70. This gives many options for fabrication of the rollway paths for all of the segmented sheave assemblies. As an example, if one quadrant is modified to a shorter major axis arc length on each of the guide segmented sheave assemblies, a new load arc surface can be obtained by flipping each guide segmented sheave array end to end thereby extending the operating life of the guide rollways. As another example, the deflection angle between guide and measurement segmented sheave assemblies is shown to be Φ=10 degrees. It is anticipated that if the segmented sheave assemblies are disposed to yield a deflection angle of Φ=5 degrees, the force F, hence the resolution, will be reduced by approximately 50 percent. Even with this reduction, a tension measurement resolution of 1 part per 1,000 to 10,000 or more (of the full scale output or "FSO") is obtainable to yield an accuracy of better than ±1% FSO. As yet another example, alternate "four center" ellipse structure of the segmented sheave assembly rollways will yield identical results (see "Technical Drawing", Gieseeke, Mitchell, Spencer and Hill; Macmillan, New York, N.Y., 1974, Sixth Edition, pages 508–511).

Note that in both approximate ellipse and four center ellipse constructions, all elements are true arcs. While the scope of the invention does not rigidly require this feature, true arcs produce optimum deflection for a given cable stress, and they are easier to machine than compound curves. Acceleration derivatives or "jerks" at tangential points are not damaging if the rollers are not loaded by the cable.

Figure 6:
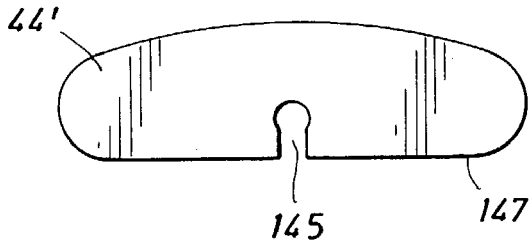
FIG. 6 is cross sectional view of a rollway with a gap in the return path of its perimeter.

There are other variations in the segmented sheave assembly tensiometer that can be made while still remaining within the operational framework of the invention. Also note that discontinuities or "gaps" in the perimeter of a rollway can exist, such as illustrated conceptually in FIG. 6. A rollway 44' has a gap 145 in its perimeter 147. These discontinuities may be related to rollway mounting structure, rollway adjustment requirements, and the like. The gap 145 is shown in the return path of the perimeter 147. It is highly desirable to avoid introducing any discontinuities in the load arc portion of the rollway. It is also preferred that the rollers of all sheave segments 30 remain in constant contact with the perimeter of the rollway 44, and constant contact is essential while the segments are in contact with the cable and under load on the load arc portion of the perimeter.

In summary, it is not necessary for the segmented sheave assembly elements to be symmetrical, nor is it necessary for them to be the same size or the same shape. There are other ways, apparent to those skilled in the art, in which the segmented sheave assembly tensiometer can be modified while remaining within the scope of the invention. While typically not preferred, segmented sheave assemblies and conventional "wheel" sheaves can be used in combination in a multiple sheave tensiometer.

As discussed previously, there are many applications for the segmented sheave assembly tensiometer. One application is at the well head of a subsea well borehole, which can currently be as deep as 9,000 feet. At these depths with accompanying pressure, it is highly desirable to pressure compensate strain gage elements of the segmented sheave assembly tensiometer. The housing structure 110 shown in FIG. 4*b* may be filled with a fluid, such as a silicon grease, to protect internal components. Such a fluid can be very thick to generally stay in place for moderate term direst exposure. Alternately, the tensiometer measuring system can be fabricated as a compliant sealed system with a non-conductive oil fill to isolate the measuring circuitry (not illustrated) from water and to equalize the pressure at the components to that at operating depth.

Tensiometers Comprising One to Five Sheave Assemblies

Figure 7:
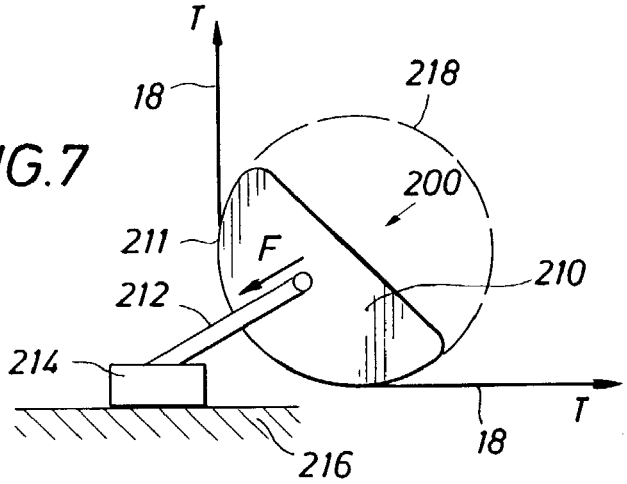
FIG. 7 is a tensiometer comprising one segmented sheave assembly.

FIG. 7 shows a tensiometer 200 comprising a single segmented sheave assembly 210. The broken lines illustrate a sheave wheel 218 of equivalent radius. The cable 18 contacts the sheave assembly at a load arc 211 exerting a force F through a connecting means 212 to a force measuring means 214 disposed on a fixed object 216. Tension T on the cable 18 is determined from a generalized relationship (discussed above)

$$T=f(K,F)$$

where F is measured and K is a design constant of the tensiometer 210.

Figure 8:
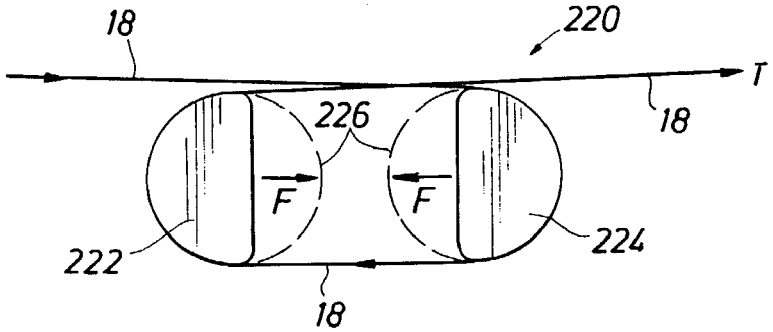
FIG. 8 is a tensiometer comprising two segmented sheave assemblies.

FIG. 8 shows a tensiometer 220 comprising two segmented sheave assemblies 222 and 224. The broken lines illustrate a sheave wheels 226 of equivalent radii. Starting from the left of FIG. 8, the cable 18 contacts the top of sheave assembly 224, wraps approximately 180° to the bottom of the sheave assembly 224, contacts the bottom of the sheave assembly 222, wraps approximately 180° to the top of the sheave assembly 222, and departs the tensiometer 220 to the right. The forces F exerted upon the sheave assemblies 222 and 224 are measured with a force measuring means (not shown for clarity). Tension T on the cable 18 is again determined from a generalized relationship (as discussed above)

$$T=f(K,F)$$

where F is measured and K is a design constant of the tensiometer 220.

Figure 9:
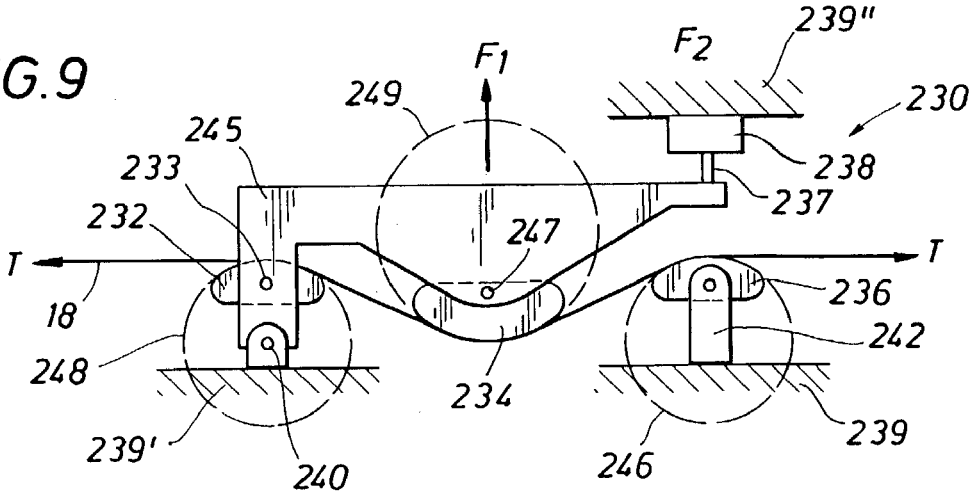
FIG. 9 is a tensiometer comprising an alternate embodiment of a tensiometer comprising three segmented sheave assemblies.

FIG. 9 shows an alternate embodiment of a three segmented sheave assembly tensiometer 230 comprising a measure sheave assembly 234 attached to a frame 245 by means of an attachment device 247 such as a pivot pin. A first guide sheave assembly is attached to the frame 245 with attachment means 233. The frame 245 is pivotally attached to a fixed object at a position 239 by means of a pivotal fixture 240. A second guide sheave assembly 236 is attached to the fixed object at a position 239' by means of a pivotal fixture 242. The broken lines 248, 249 and 246 illustrate sheave wheels of equivalent radius for the segmented sheave assemblies 232, 234 and 236, respectively. The frame 245 is operationally attached by the means 237 to a force measuring means 238 affixed to the fixed object at a position 239". Starting from the left of FIG. 9, the cable 18 contacts the sheave assembly 232, is deflected and contacts the measurement segmented sheave 234, is again deflected and contacts the sheave assembly 236, where it is again deflected and departs the tensiometer 230 to the right. A force $F_1$ is exerted upon the frame 245 at the position of the measurement segmented sheave 234. This force is transferred by the rigid frame 245 as a force $F_2$, which is measured by the force measuring means 238. Tension T on the cable 18 is once again determined from a generalized relationship $$T=f(K,F_2)$$

where $F_2$ is measured and K is a design constant of the tensiometer 230.

Figure 10:
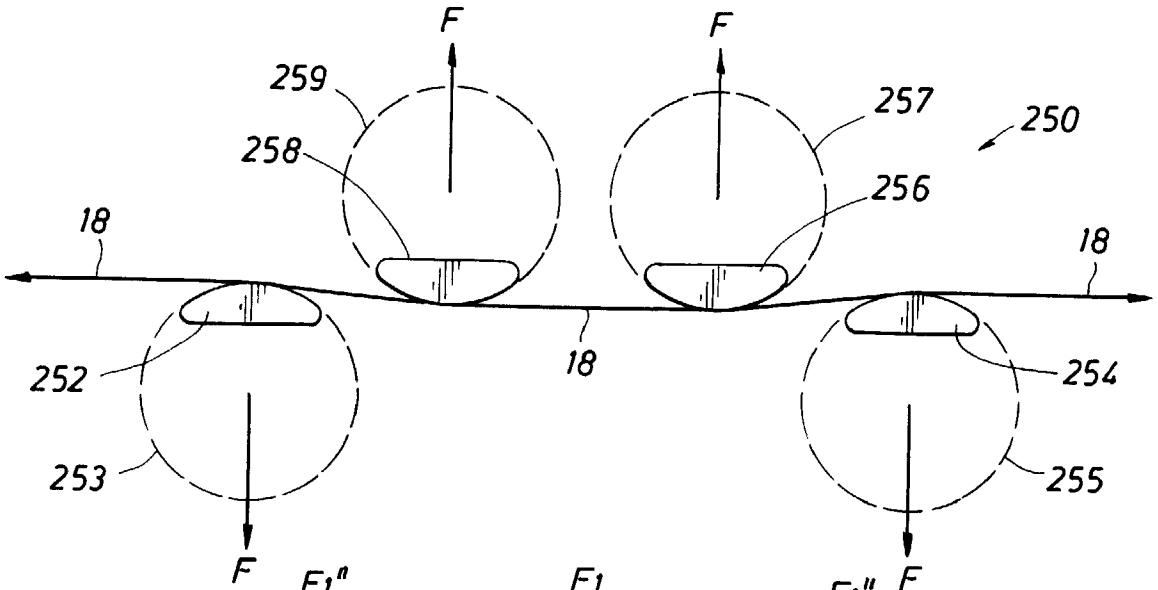
FIG. 10 is a tensiometer comprising four segmented sheave assemblies.

FIG. 10 shows a tensiometer 250 comprising four segmented sheave assemblies 252, 258, 256 and 254. The broken lines 253, 259, 257 and 255, illustrate a sheave wheels with radii equivalent to the segmented sheave assemblies 252, 258, 256 and 254, respectively. The sheave assemblies are arranged so that vertical force components F, induced at each sheave assembly by the cable 18 under tension T, are equal and opposite as illustrated in FIG. 10. The result is uniform moment between inboard sheave assemblies 258 and 256, and uniform shear force between the inboard sheave assemblies and the outboard sheave assemblies 252 and 254. Both bending and shear are good for transduction. Force F is measured by one or more force or moment measuring means (not shown), and tension in the cable is determined using the generalized relation $$T=f(K,F)$$

where F is measured and K is a design constant of the tensiometer 250.

Figure 11:
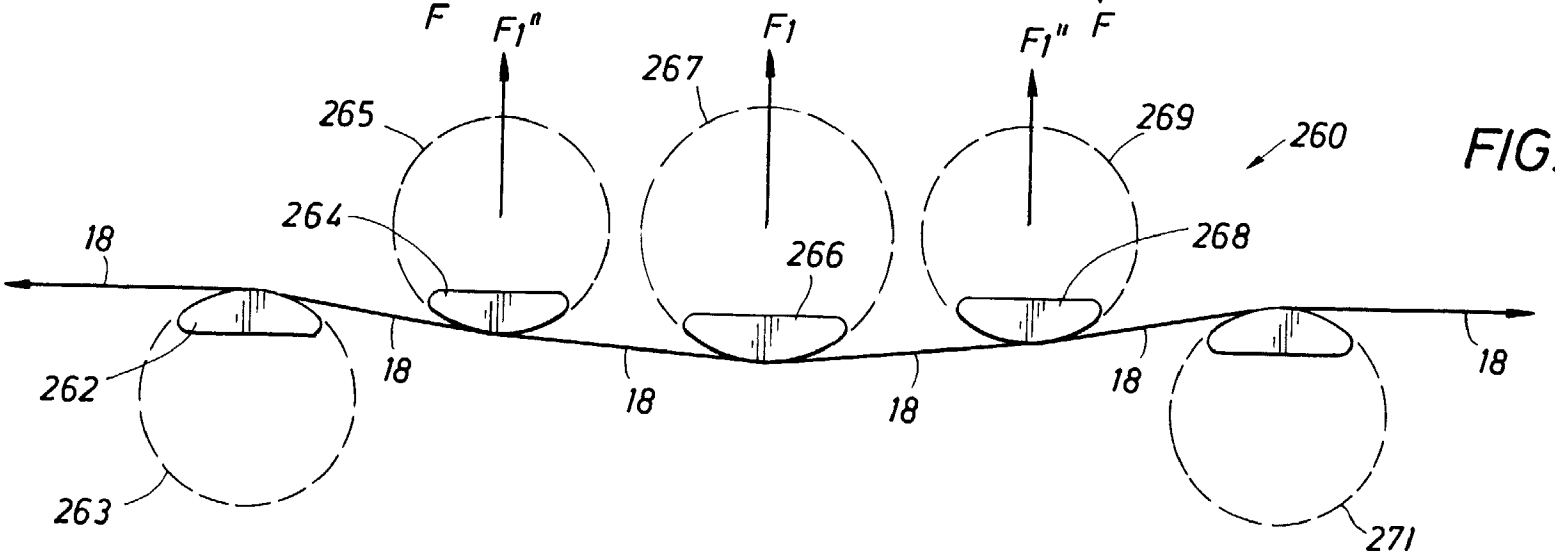
FIG. 11 is a tensiometer comprising five segmented sheave assemblies.

FIG. 11 shows a tensiometer 270 comprising five segmented sheave assemblies 262, 264, 266, 268 and 270. The broken lines 263, 265, 267, 269 and 271, illustrate a sheave wheels with radii equivalent to the segmented sheave assemblies 262, 264, 266, 268 and 270, respectively. The effective diameter of the cable 18 can decrease due to wear, or increase due to buildup of material on the cable. Tensiometers are calibrated for a specific tubular diameter. Any variation in the diameter of the tubular will, therefore, result in systematic error in the corresponding tension measurement. Outboard sheave assemblies 262 and 270 push the cable 18 into registry with the inner sheave assemblies 264 and 268. This preserves the angular relationship between guide sheave assemblies 264 and 268 and the measurement segmented sheave assembly 266 for which the tensiometer is calibrated. Calibration, and therefore accuracy of the tension measurement, is unaffected by changes in effective diameter of the cable. As in the previously discussed three sheave assembly shown in FIG. 5, force $F_1$, exerted by the cable under tension T is preferably measured at the measurement segmented sheave assembly 266. Alternately, forces $F_1'$ or $F_1'$ can be measured at the sheave assemblies 264 and 268, respectively. Force measuring means are not shown for clarity. Using the first option, tension in the cable is determined using the generalized relation $$T=f(K,F_1)$$

where $F_1$ is measured and K is a design constant of the tensiometer 260.

While the foregoing disclosure is directed toward the preferred embodiments of the invention, the scope of the invention is defined by the claims, which follow.

I claim:

1. A segmented sheave assembly comprising:

(a) a plurality of sheave segments each comprising (i) a segment body, (ii) at least one roller disposed on one side of said segment body, and (iii) an axial groove in said segment body on a side opposing said at least one roller, the axial groove adapted to receive a tubular;

(b) a rollway comprising a major axis and a minor axis and with a perimeter which contacts said at least one roller disposed in each of said plurality of sheave segments; and (c) linking means attaching said segment bodies of said plurality of sheave elements to form a continuous sheave chain encircling and rotatable about said rollway.

2. The apparatus of claim 1 wherein each of said at least one roller disposed in each said segment body simultaneously contacts said perimeter of said rollway.

3. The apparatus of claim 1 wherein:

(a) said perimeter comprises an approximate ellipse segment forming a load arc; and (b) wherein a tubular is received in said axial groove of one or more of said sheave segments contacting said load arc.

4. The apparatus of claim 3 wherein said perimeter defines a linear return segment.

5. The apparatus of claim 1 wherein said linking means comprise side plates pivotally attached to adjacent said sheave segments.

6. A method for forming a sheave comprising:

(a) providing a plurality of sheave segments each comprising (i) a segment body, (ii) at least one roller disposed on one side of said segment body, and (iii) an axial groove in said segment body on a side opposing said at least one roller; and (b) linking said plurality of sheave segments to form a continuous chain encircling a rollway with a major and a minor axis and with a perimeter which contacts said at least one roller disposed in each of said plurality of sheave elements; wherein (c) said plurality of sheave elements are linked with linking means pivotally attached to adjacent said segment bodies and said chain is rotatable about said rollway.

7. The method of claim 6 comprising simultaneously contacting said perimeter with each of said least one roller disposed in each said segment body.

8. The method of claim 6 comprising:

(a) fabricating said rollway with said perimeter comprising an approximate ellipse segment forming a load arc; and (b) fabricating said axial grooves with an arc matching said load arc.

9. The method of claim 8 comprising fabricating said rollway with a perimeter comprising a straight return segment.

* * * * *